US005497640A

United States Patent [19]

Kokuryo

[11] Patent Number: 5,497,640

[45] Date of Patent: Mar. 12, 1996

[54] DOOR LOCKING SYSTEM FOR VEHICLES

[75] Inventor: Yoshiki Kokuryo, Yokohama, Japan

[73] Assignee: Nissan Motor Co., Ltd., Yokohama, Japan

[21] Appl. No.: 273,836

[22] Filed: Jul. 12, 1994

[30] Foreign Application Priority Data

Jul. 15, 1993 [JP] Japan ..... 5-175046

[51] Int. Cl.[6] ..... E05B 47/00

[52] U.S. Cl. ..... 70/237; 70/277; 70/279; 70/283; 292/336.3

[58] Field of Search ..... 70/237, 264, 277–283; 292/336.3

[56] References Cited

U.S. PATENT DOCUMENTS 4,904,006 2/1990 Hayakawa ..... 292/336.3

FOREIGN PATENT DOCUMENTS 0554913 8/1993 European Pat. Off. ..... 70/237
1514532 6/1978 United Kingdom ..... 292/336.3

*Primary Examiner*—Lloyd A. Gall

*Attorney, Agent, or Firm*—Foley & Lardner

[57] ABSTRACT

In a door locking system of the type having an electric or electromagnetic safety mechanism, a locking lever is made of separate first and second lever sections. The first lever section is fixedly attached to a rotary shaft and connected to a lock cylinder. The second lever section is rotatable on the shaft and connected to a locking button. The safety mechanism is capable of locking the second lever section in the locking position thereof. A projection and a recess which are engageable with each other, are provided to the first and second lever sections such that the first and second lever sections are rotatable as one body when the first lever section is driven toward the locking position thereof or the second lever section is driven toward the unlocking position thereof. A torsional spring is provided between the first and second lever sections so that when the second lever section is in a locked condition, only the first lever section can be rotated to unlock the locking mechanism, whereas when the second lever section is in an unlocked condition, a force for operating the first lever section toward the unlocking position thereof or a force for operating the second lever section toward the locking position thereof can be transmitted between the first and second lever section for thereby allowing the first and second lever sections to rotate as one body.

7 Claims, 3 Drawing Sheets

DOOR LOCKING SYSTEM FOR VEHICLES

BACKGROUND OF THE INVENTION

1. Field of the Invention

The present invention relates in general to a door locking system for vehicles and particularly to an automotive door locking system of the type having an antitheft deadlocking or safety mechanism.

2. Description of the Prior Art

A known door locking system is provided with an antitheft deadlocking or safety mechanism adapted to hold a locking lever, which is movable between a locking position and an unlocking position for locking and unlocking the locking mechanism, in the locking position and prevent movement of the locking lever out of the locking position when the locking mechanism has been locked by a lock cylinder which is manually operated from the outside of the door with a key. Insofar as the safety mechanism blocks movement of the locking lever out of the locking position, the locking mechanism cannot be unlocked by a locking button which is manually operated from the inside of the door. By this, it is intended to attain an improved antitheft effect.

FIGS. 4 and 5 show an example of a prior art door locking system of the above described kind.

In the figures, 1 is a locking mechanism installed on a door "D". 2 is a lock cylinder disposed adjacent an outside door handle 3 and adapted to be operated from the outside of the door "D" with a key. 4 is a locking button installed on a waist portion of the door "D" in such a way as to project upward therefrom and adapted to be operated from the inside of the door "D". 5 is an inside door handle. 6 is a locking lever fixedly attached to a locking shaft 7 of the locking mechanism 1 and movable between a locking position and an unlocking position for locking and unlocking the locking mechanism 1. The locking lever 6 is connected via pull rods 8 and 9 to the lock cylinder 2 and the locking button 4 so that the operation of the locking mechanism 1 can be controlled via the pull rods 8 and 9 by the lock cylinder 2 and the locking button 4. 10 is an antitheft deadlocking or safety mechanism which is provided with an electric actuator 11. The actuator 11 has a reciprocative rod 12 which is movable between an engaging position and a disengaging position where the rod 12 engages in and disengages from a recessed portion 13 of the locking lever 6 under drive of a drive means which is electrically actuated. By the operation of the safety mechanism 10, the locking lever 6 is selectively locked and unlocked.

The operation of the safety mechanism 10 is controlled on the basis of a signal from a detector (not shown) provided to the lock cylinder 2 to detect whether the lock cylinder 2 is operated toward a locking position or an unlocking position with a proper key. When the locking mechanism 1 has been locked by the operation of the lock cylinder 2, the safety mechanism 10 is electrically actuated or operated to lock the locking lever 6 in the locking position. When the locking mechanism 1 is unlocked by the operation of the lock cylinder 2, the safety mechanism 10 unlocks the locking lever 6.

14 is a pull rod connecting between the outside handle 3 and the locking mechanism 1, and 15 is a pull rod connecting between the inside handle 5 and the locking mechanism 1.

A similar door locking system of the above described kind is disclosed in "New Car Service Manual for Passat 319A", published on May, 1990 by Nissan Motor Co., Ltd. and GB 2,034,802.

A problem of the door locking system of the above described kind is that when a storage battery has been discharged or has been removed so that there is no supply of current to the safety mechanism, the safety mechanism becomes inoperative, so when the storage battery is discharged under a locking condition of the safety mechanism, i.e., under a condition in which the locking lever is locked by the operation of the safety mechanism, it becomes impossible to unlock the locking mechanism even by the lock cylinder which is operated with a key.

SUMMARY OF THE INVENTION

According to an aspect of the present invention, there is provided a locking system for a door which comprises a locking mechanism having a rotary shaft and a locking lever installed on the shaft for movement between a locking position and an unlocking position for causing the locking mechanism to be locked and unlocked, respectively, a lock cylinder manually operated from the outside of the door to lock or unlock the locking mechanism, a locking button manually operated from the inside of the door to lock or unlock the locking mechanism, and a safety mechanism electrically or electromagnetically operated, in response to an operation of the lock cylinder for locking the locking mechanism, to lock the locking lever in the locking position thereof and disable said locking lever from being unlocked until the locking mechanism is unlocked by the operation of the lock cylinder.

The locking lever is made up of separate first and second lever sections. The first lever section is connected to the lock cylinder and fixedly attached to the rotary shaft for rotation together therewith. The second lever section is connected to the locking button and rotatable on the rotary shaft. The second lever section is capable of being locked in a position corresponding to the locking position of the locking lever by a locking operation of the safety mechanism.

The locking system further comprises engagement means for interconnecting the first and second lever sections and allowing the same to rotate as one body when the locking button is operated to drive the second lever section toward a position corresponding to the unlocking position of the locking lever or when the lock cylinder is operated to drive the first lever section toward a position corresponding to the locking position of the locking lever, and spring means provided between the first and second lever sections for urging the lever sections in the opposite directions to cause the engagement means to abuttingly engage with each other and transmitting therethrough between the first and second lever members an operating force applied to the locking button for driving the second lever section toward a position corresponding to the locking position of the locking lever or an operating force applied to the lock cylinder for driving the first lever section toward a position corresponding to the unlocking position of the locking lever.

According to another aspect of the present invention, there is provided a locking system for a door which comprises a locking mechanism having a rotary shaft, a first locking lever member fixedly attached to the shaft and a second locking lever member rotatable on the shaft, the first locking lever member being rotatable with the shaft between a locking position and an unlocking position for causing the locking mechanism to be locked and unlocked, respectively, a lock cylinder connected to the first locking lever member and manually operated from the outside of the door to drive the first locking lever member between the locking position and the unlocking position, a locking button connected to the second locking lever member and manually operated from the inside of the door to drive the second locking lever member between a locking position and an unlocking position, abutment means for abuttingly engaging the first and second locking lever members with each other and allowing the same to rotate as one body when the locking button is operated to drive the second locking lever member toward the unlocking position thereof or when the lock cylinder is operated to drive the first locking lever member toward the locking position thereof, spring means for urging the first and second locking lever members in the opposite directions to cause the abutment means to abuttingly engage with each other and transmitting therethrough between the first and second locking lever members an operating force applied to the locking button for driving the second locking lever member toward the locking position thereof or an operating force applied to the lock cylinder for driving the first locking lever member toward the unlocking position thereof, and a safety mechanism electrically or electromagnetically operated, in responsive to an operation of the lock cylinder for locking the locking mechanism, to lock the second locking lever member in the locking position thereof and disable said locking lever from being unlocked until the lock cylinder is operated to unlock the locking mechanism.

The above structure is effective for solving the above noted problem inherent in the prior art door locking system.

It is accordingly an object of the present invention to provide a novel and improved door locking system which makes it possible to unlock a locking mechanism by the operation of a lock cylinder with a key even when a safety mechanism, which is operated electrically or electromagnetically and in a locking condition to block movement of a locking lever of the locking mechanism out of a locking position, becomes inoperative due to discharge or removal of a storage battery.

It is a further object of the present invention to provide a novel and improved door locking system of the above described character which can assuredly prevent automobile theft or theft from automobiles since the locking mechanism, after a lock cylinder is operated to lock the locking mechanism with a key, cannot be unlocked by the operation of a locking button even if an access to the locking button is gained by a breaking of a door glass.

BRIEF DESCRIPTION OF THE INVENTION

DETAILED DESCRIPTION OF THE PREFERRED EMBODIMENT

Figure 1:
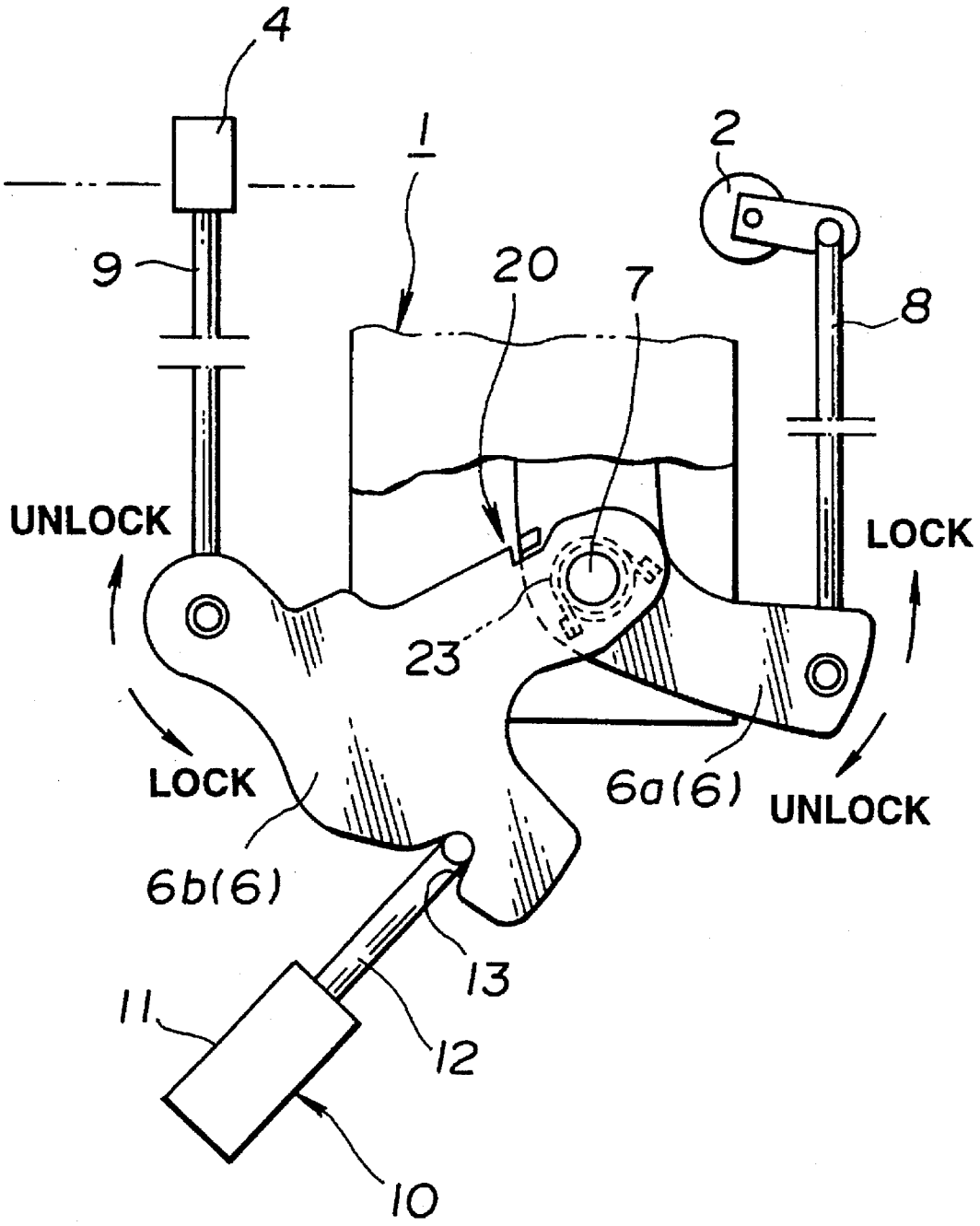
FIG. 1 is a schematic view of an important portion of a door locking system of the present invention.
Figure 2:
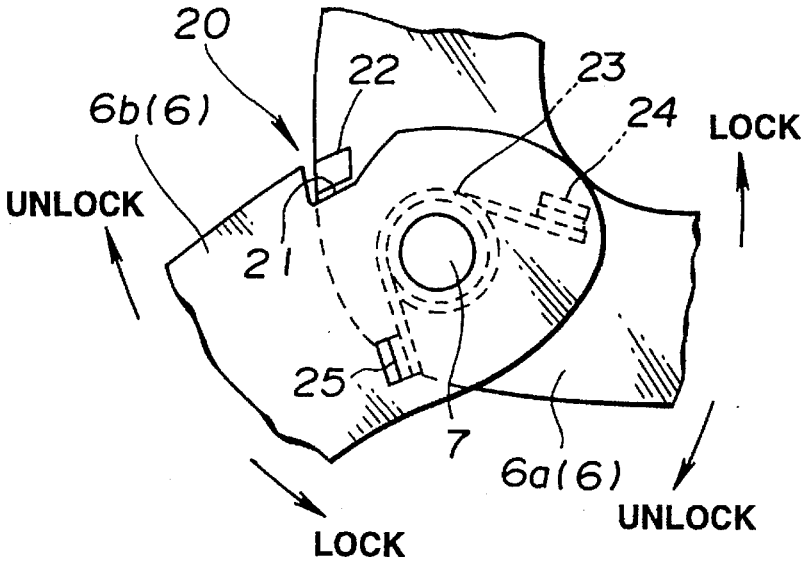
FIG. 2 is an enlarged view of a portion of the door locking system of FIG. 1.
Figure 3:
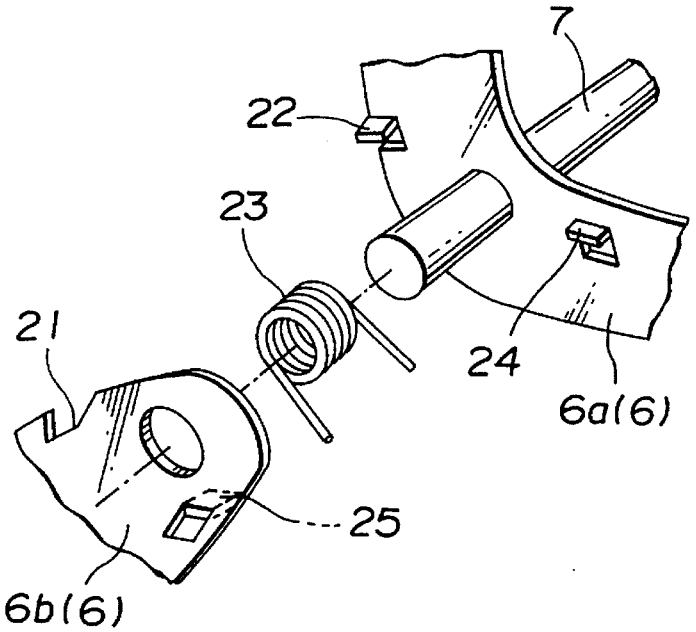
FIG. 3 is an exploded, perspective view of the portion of FIG. 2.
Figure 4:
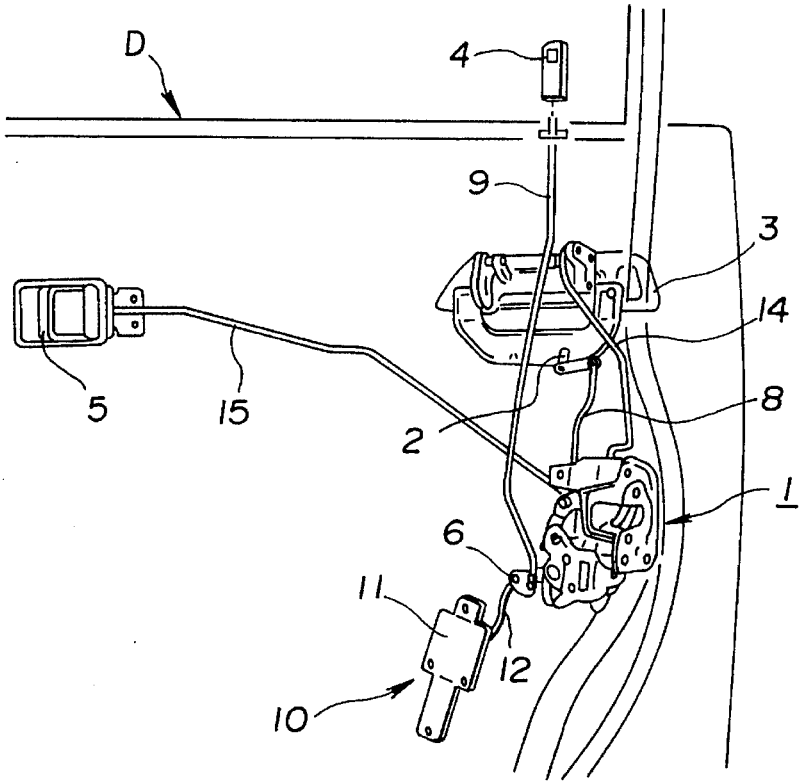
FIG.4 (PRIOR ART)
FIG. 4 is a schematic perspective view of a prior art locking system.
Figure 5:
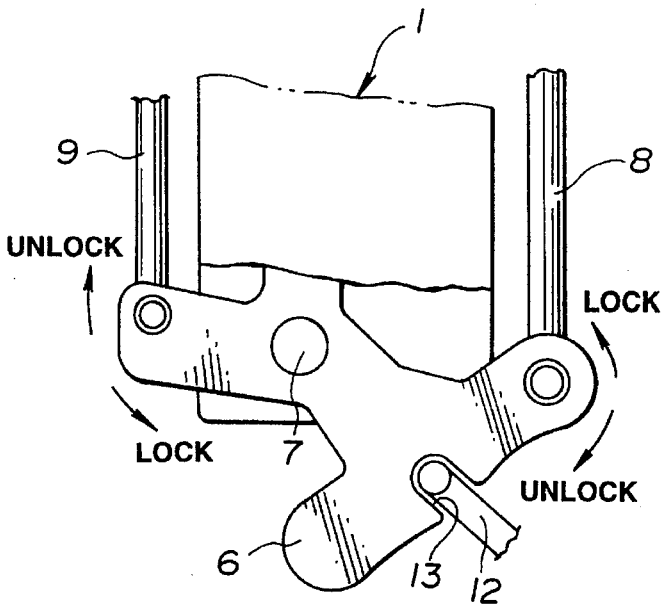
FIG.5 (PRIOR ART)
FIG. 5 is a schematic view of a portion of the prior art locking system of FIG. 4.

Referring to FIGS. 2 to 4 in which similar parts to those of the prior art locking system of FIGS. 4 and 5 are designated by similar characters, a door locking system of the present invention is substantially similar to the above described prior art locking system except for a locking lever assembly 6.

The locking lever assembly 6 includes independent or separate first and second locking lever members **6*a* and 6*b*. The first locking lever member 6*a* is fixedly attached to a rotary shaft 7 of the locking mechanism 1 for rotation therewith between a locking position and an unlocking position for causing locking and unlocking of the locking mechanism 1. The first locking lever member 6*a* is connected at an end thereof by way of the pull rod 8 to a lock cylinder 2 which is manually operated from the outside of a door "D". The locking mechanism 1 is adapted to be locked and unlocked by the operation of the lock cylinder 2 with a key. The second locking lever member 6*b* is shaped like a bell crank and has three apex portions. The second locking lever member 6*b* is rotatably supported at a first apex portion thereof on the shaft 7 and connected at a second apex portion thereof to the locking button 4 by way of the pull rod 9. The locking button 4 is manually operated from the inside of the door "D". The second locking lever member 6*b* has at a third apex portion thereof a recess 13 in which an end of a reciprocative rod 12 of the safety mechanism 10 is engageable. When the rod 12 is engaged in the recess 13, the second locking lever member 6*b* becomes incapable of rotating about the shaft 7 and is held stationarily in a locking position thereof. When the rod 12 is disengaged from the recess 13, the second locking lever member 6*b* becomes rotatable about the shaft 7** and thus movable out of the locking position toward an unlocking position thereof.

An engagement means 20 is provided between the first and second locking lever members **6*a* and 6*b* for abuttingly engaging them with each other for thereby making them rotatable as one body when the first and second locking lever members 6*a* and 6*b*** are driven to rotate in predetermined directions, respectively.

Specifically, the engagement means 20 consists of a grooved or recessed portion 21 and a projection 22 for engagement with and disengagement from the recessed portion 21. The recessed portion 21 is formed in an upper periphery of the second locking lever member **6*b* at a location adjacent the shaft 7. The projection 22 is integral with the first locking lever member 6*a*. When the first locking lever member 6*a* is urged for rotation toward the locking position thereof or the second locking lever member 6*b* is urged for rotation toward the unlocking position thereof, the recessed portion 21 and the projection 22 are abutingly engaged with each other to make the first and second locking lever members 6*a* and 6*b* rotatable together as one body. When the lock cylinder 2 is operated to apply to the first locking lever member 6*a* an operating force for driving the first locking lever member 6*a* toward the unlocking position thereof while the second locking lever member 6*b* being locked by the operation of the safety mechanism 10, the recessed portion 21 and the projection 22 are disengaged from each other to enable only the first locking lever member 6*a*** to rotate into the unlocking position thereof.

A torsional set spring 23 is disposed between the first and second locking lever members **6*a* and 6*b* and installed on or placed around the shaft 7. The first and second locking lever members 6*a* and 6*b* have integral projections 24 and 25 adjacent the shaft 7, respectively. The spring 23 in a loaded state is engaged at opposite ends thereof with the respective projections 24 and 25 in such a manner as to urge the first and second locking lever members 6*a* and 6*b* to rotate in opposite directions for thereby urging the recessed portion 21 and the projection 22** to be engaged with each other.

This spring 23 is set or loaded so as to exert a spring force which is larger than an operating force necessary for locking or unlocking the locking mechanism 1 so that an operating force applied to the locking button 4 for locking the locking mechanism 1 and an operating force applied to the lock cylinder 2 for unlocking the locking mechanism 1 can be transmitted between the first and second locking lever members 6*a* and 6*b*.

With the above described locking system, when the lock cylinder 2 is manually operated to lock the locking mechanism 1, the recessed portion 21 and the projection 22 of the engagement means 20 are caused to abut upon each other to allow the first and second lever members 6*a* and 6*b* to rotate as one body and lock the locking mechanism 1.

When the lock cylinder 2 is manually operated to unlock the locking mechanism 1, an operating force is transmitted from the first locking lever member 6*a* to the second locking lever member 6*b* by way of the set spring 23, thus causing the first locking lever member 6*a* to rotate together with the second locking lever member 6*b* to unlock the locking mechanism 1.

When the locking button 4 is manually operated to lock the locking mechanism 1, an operating force is transmitted from the second locking lever member 6*b* to the first locking lever member 6*a* by way of the set spring 23, thus causing the first locking lever member 6*a* to rotate together with the second locking lever member 6*b* to lock the locking mechanism 1.

When the locking button 4 is operated to unlock the locking mechanism 1, the recessed portion 21 and the projection 22 of the engagement means 20 are caused to abut upon each other to make the first and second lever members 6*a* and 6*b* rotate as one body to unlock the locking mechanism 1.

When the lock cylinder 2 is to be operated in the above mentioned manner to lock the locking mechanism 1, a key is inserted into the lock cylinder 2 and moved toward a locking position thereof. This movement of the key toward the locking position is detected by a detector (not shown). The detector then causes an electric actuator 11 of the safety mechanism 10 to be driven or operated electrically. The reciprocative rod 12 is thus caused to move forward and engage in the recess 13 of the second locking lever member 6*b*. By this, the second locking lever member 6*b* is locked or becomes immovable while holding the locking mechanism 1 in a locked condition, whereby a so-called deadlocking condition is obtained.

Accordingly, even if it is attempted to break the door glass and operate the locking button 4 to unlock the locking mechanism 1, this attempt is blocked by the safety mechanism 10 and thus unauthorized unlocking of the locking mechanism 1 is prevented, thus making it possible to attain an assured antitheft effect. When the battery, under the above described deadlocking condition, is discharged, the actuator 11 cannot be powered to effect motor drive for causing the rod 12 to be disengaged from the second locking lever member 6*b*. Thus, by the operation of the lock cylinder 2 with a key for unlocking the locking mechanism 1, the second locking lever member 6*b* cannot be released from the locked or immovable condition prior to unlocking of the locking mechanism 10.

However, when the lock cylinder 2 is operated with a key to unlock the locking mechanism 1, the first locking lever member 6*a* is solely rotated toward the unlocking position against the bias of the set spring 23, thus enabling to unlock the locking mechanism 1.

While the locking button has been described and shown as being provided to the door waist portion, this is not for the purpose of limitation. For example, the present invention may be applied to a locking button or knob disposed adjacent an inside door handle.

Further, while the actuator of the safety mechanism has been described and shown as being of an electrically actuated or operated type, this is not for the purpose of limitation. For example, it may be of the electromagnetically actuated or operated type.

In the foregoing, it is to be noted that according to the present invention a locking lever is separated into first and second lever sections, the first lever section being connected by way of a pull rod to a lock cylinder to actually lock and unlock a locking mechanism, and an engagement means and a set spring are disposed between the first and second lever sections to enable, when the safety mechanism is not operated to lock the second lever section, the first and second lever sections to rotate as one body and enable, when the lock cylinder is operated to unlock the locking mechanism and the safety mechanism is operated to lock the second lever section, only the first lever section to rotate in the corresponding direction.

Accordingly, even when the storage battery is completely discharged under a deadlocking condition of the locking mechanism, i.e., under a condition in which the second locking lever is locked by the safety mechanism, the locking mechanism can be unlocked by the operation of the lock cylinder with a key.

What is claimed is:

1. A locking system for a door comprising:

a locking mechanism having a rotary shaft, a first locking lever member fixedly attached to said shaft and a second locking lever member rotatable on said shaft, said first locking lever member being rotatable with said shaft between a locking position and an unlocking position for causing said locking mechanism to be locked and unlocked, respectively;

a lock cylinder connected to said first locking lever member and manually operated from the outside of the door to drive said first locking lever member between the locking position and the unlocking position;

a locking button connected to said second locking lever member and manually operated from the inside of the door to drive said second locking lever member between a locking position and an unlocking position;

abutment means for abuttingly engaging said first and second locking lever members with each other and allowing the same to rotate as one body when said locking button is operated to drive said second locking lever member toward the unlocking position thereof or when said lock cylinder is operated to drive said first locking lever member toward the locking position thereof;

spring means for urging said first and second locking lever members in opposite directions to cause said abutment means to abuttingly engage with each other and transmitting therethrough between said first and second locking lever members an operating force applied to said locking button for driving said second locking lever member toward the locking position thereof or an operating force applied to said lock cylinder for driving said first locking lever member toward the unlocking position thereof; and a safety mechanism electrically or electromagnetically operated, in responsive to an operation of said lock cylinder for locking said locking mechanism, to lock said second locking lever member in the locking position thereof and disable said first locking lever member from being unlocked until said lock cylinder is operated to unlock said locking mechanism.

2. A door locking system according to claim 1, wherein said spring means comprises a torsional spring having opposite ends engaged with said first and second locking lever members, respectively and capable of producing a spring force larger than a force necessary for operating said lock cylinder or said locking button.

3. A door locking system according to claim 2, further comprising a pair of stoppers in the form of projections provided to said first and second locking lever members, respectively, said opposite ends of said torsional spring being engageable with said stoppers, respectively.

4. A door locking system according to claim 1, wherein said abutment means comprises a projection and an abutment face provided to said first and second locking lever members, respectively.

5. A door locking system according to claim 1, wherein said second locking lever member comprises a recess, and said safety mechanism comprises a reciprocative rod and an actuator electrically or electromagnetically driven in one direction for causing said reciprocative rod to engage at an end in said recess and in the opposite direction for causing said reciprocative rod to disengage from said recess.

6. A door locking system according to claim 1, further comprising a first rod connecting between said lock cylinder and said first locking lever member, and a second rod connecting between said locking button and said second locking lever member.

7. A locking system for a door comprising:

a locking mechanism having a rotary shaft and a locking lever installed on said shaft for movement between a locking position and an unlocking position for causing said locking mechanism to be locked and unlocked, respectively;

a lock cylinder manually operated from the outside of the door to lock or unlock said locking mechanism;

a locking button manually operated from the inside of the door to lock or unlock said locking mechanism;

a safety mechanism electrically or electromagnetically operated, in response to an operation of said lock cylinder for locking said locking mechanism, to lock said locking lever in the locking position thereof and disable said locking lever from being unlocked until said locking mechanism is unlocked by the operation of the lock cylinder;

said locking lever being made up of separate first and second lever sections, said first lever section being connected to said lock cylinder and fixedly attached to said rotary shaft for rotation together therewith, said second lever section being connected to said locking button and rotatable on said rotary shaft, said second lever section being capable of being locked in a position corresponding to the locking position of said locking lever by a locking operation of said safety mechanism;

engagement means for interconnecting said first and second lever sections and allowing the same to rotate as one body when said locking button is operated to drive said second lever section toward a position corresponding to the unlocking position of said locking lever or when said lock cylinder is operated to drive said first lever section toward a position corresponding to the locking position of said locking lever; and spring means provided between said first and second lever sections for urging said lever sections in opposite directions to cause said engagement means to abuttingly engage with each other and transmitting therethrough between said first and second lever sections an operating force applied to said locking button for driving said second lever section toward a position corresponding to the locking position of said locking lever or an operating force applied to said lock cylinder for driving said first lever section toward a position corresponding to the unlocking position of said locking lever.

* * * * *